United States Patent [19]

Bergkvist

[11] Patent Number: 4,744,012

[45] Date of Patent: May 10, 1988

[54] LIGHTING ASSEMBLAGE

[76] Inventor: Lars A. Bergkvist, Västmansvägen 16, S-890 23 Själevad, Sweden

[21] Appl. No.: 881,039

[22] PCT Filed: Nov. 5, 1985

[86] PCT No.: PCT/SE85/00436

§ 371 Date: Jun. 24, 1986

§ 102(e) Date: Jun. 24, 1986

[87] PCT Pub. No.: WO86/03045

PCT Pub. Date: May 22, 1986

[30] Foreign Application Priority Data

Nov. 6, 1984 [SE] Sweden ..... 8405563

[51] Int. Cl.[4] ..... F21V 9/16; G09F 13/20

[52] U.S. Cl. ..... 362/84; 40/542; 40/543

[58] Field of Search ..... 362/84; 40/542, 543

[56] References Cited

U.S. PATENT DOCUMENTS

| | | | |
|---|---|---|---|
| 2,213,868 | 9/1940 | Lucian | 40/543 |
| 2,709,863 | 6/1955 | Bevacqua | 40/542 |
| 2,878,606 | 3/1959 | Meijer | 40/543 |
| 3,270,201 | 8/1966 | Hardesty | 40/543 |

FOREIGN PATENT DOCUMENTS

| | | |
|---|---|---|
| 554288 | 2/1923 | France . |
| 2011141 | 2/1970 | France . |
| 2138495 | 1/1973 | France . |
| 256732 | 8/1948 | Switzerland . |
| 282567 | 4/1952 | Switzerland . |
| 2,040,534 | 8/1980 | United Kingdom . |

OTHER PUBLICATIONS

PCT/US83/01483 Publ. No. WO84/01460, Apr. 12, 1984.

*Primary Examiner*—Douglas Hart

*Attorney, Agent, or Firm*—Nies, Webner, Kurz & Bergert

[57] ABSTRACT

A lamp unit comprising a box-like body which is provided with one or more apertures covered with a sheet of material transparent to visible light and which houses a light source. In accordance with the invention the side (10) of the sheet (6) or sheets facing inwardly of the body (1) is, or are, covered totally or partially with a layer of a substance which fluoresces when irradiated with ultraviolet light, and the light source (7) is arranged to transmit ultraviolet light. In accordance with one preferred embodiment of the invention the sheet (6), or sheets, is, or are, made of a material which is transparent to visible light but impermeable to ultraviolet radiation.

5 Claims, 1 Drawing Sheet

LIGHTING ASSEMBLAGE

The present invention relates to a lighting assemblage, hereinafter referred to generally as a lamp unit, incorporating a surface which is illuminated by a light source.

The lamp unit according to the invention has a wide field of use, and can be utilized as a lighting source for illuminating signs and for illuminated positional markings, etc.

The invention can be applied to particular advantage in conjunction with signs of the kind provided with text or an image which need only be emphasized during certain time periods. Examples of such signs include road signs which warn that a bridge is about to open, signs which warn against temporary hazards, etc, etc. Such signs are to be found in many different forms. A common feature of all such known signs, however, is that the text and/or image(s) provided thereon is made visible or invisible to an observer with the aid of different mechanical devices.

The present invention eliminates the need of all mechanical elements, while still enabling the text and/or image(s) on the sign to be made visible or invisible as required.

The present invention can also be applied to reference signs of various kinds, on which positional markings are also to be found and which are required to be activated solely during certain time periods.

The invention can also be applied with advantage as an illumination source for monochromatic or substantially monochromatic light, as exemplified hereinafter.

The aforementioned fields of use are merely selected examples of preferred and possible fields in which the present invention can be applied.

The present invention relates to a lighting assemblage or lamp unit which comprises a box-like body which has located therein one or more apertures which are covered with a sheet of material transparent to visible light, and which houses a light source, the lamp unit being characterized in that the side of the transparent sheet, or sheets, facing inwardly of the body is, or are covered either totally or partially with a substance layer which fluoresces when irradiated with ultraviolet light; and in that the light source is an ultraviolet light source.

The invention will now be described in more detail with reference to an exemplifying embodiment thereof illustrated in the accompanying drawings, in which FIG. 1 is a schematic sectional view of a lamp unit according to the invention, taken on the line A—A in FIG. 2;

Figure 1:
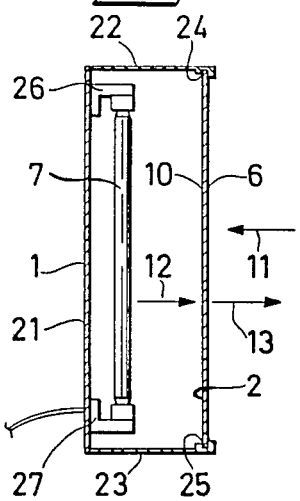

The lamp unit or lighting assemblage illustrated in the drawings includes a box-like body 1 provided with one or more apertures 2; 3–5. The aperture 2, or the apertures 3–5, is or are, covered with a respective sheet of material which is transparent to visible light. A light source 7–9 is arranged within the body 1.

In accordance with the invention, the side 10 of the sheet 6, or optionally the sheets 6, facing inwardly of the body 1 is, or are, covered totally or partially with a layer of substance which fluoresces when irradiated with ultraviolet light. A number of brands of such substances are readily available commercially. In accordance with one preferred embodiment of the invention, the substance is a paint which fluoresces when irradiated with ultraviolet light. This substance may either be one which becomes transparent or dark when irradiated with light within the visible spectrum, or a paint which exhibits a certain colour or hue even when irradiated solely with visible light. When the substance is to be irradiated solely with visible light, however, the substance or paint shall not fluoresce.

According to the present invention, the light source 7–9 is arranged to transmit ultraviolet light. According to one preferred embodiment of the invention, the light source is arranged to transmit a high proportion of ultraviolet light, preferably in the wavelength band of 360–370 nanometers.

The light source may comprise any suitable light source capable of transmitting a high proportion of ultraviolet light and a low proportion of visible light. A mercury vapour discharge lamp is one example of a suitable light source.

So-called UV-tubes, however, have been chosen in respect of the illustrated embodiments, i.e. gas vapour discharge tubes 7–9 which deliver a high proportion of ultraviolet light.

According to one preferred embodiment, the sheet or sheets 6 is, or are, provided with a uniform layer of one and the same substance which fluoresces when irradiated with ultraviolet light. This substance may, for example, be one which fluoresces with a yellow light, although substances which fluoresce with a colour other than yellow many also be used.

By coating the sheet 6 with a uniform layer of a material which fluoresces in a specific colour when irradiated with ultraviolet light, a monochromatic or substantially monochromatic light will be transmitted from the sheet in a direction away from the body 1. This embodiment can be used to great advantage as a lighting source in, inter alia, various types of instrument in which a monochromatic light source is preferred and in which a short lamp ignition time is desired.

Thus, an advantage is afforded when this embodiment is used in conjunction with instruments of the kind described in International Patent Application No. WO 82/01078. Since the layer will only fluoresce when irradiated, the front surface of the sheet 6 will only light-up in the selected colour when the light source in the body is ignited. Even though a certain amount of stray light emanating from daylight and containing ultraviolet radiation may be present, depending upon the field of application, stray light of low intensity will not result in noticeable fluorescence of the layer in comparison with the fluorescence obtained when the light source 7–9 is ignited.

According to one preferred and highly advantageous embodiment of the invention, the sheet or sheets 6 is, or are, made from a material which is transparent to visible light but impervious to ultraviolet radiation. Glass and the majority of plastics material, such as polycarbonate resins for example, are examples of materials possessing such properties.

This embodiment means that, for example, the ultraviolet component 11 of incident daylight is unable to pass through the sheet 6 to the fluorescent layer, which consequently will now fluoresce as a result of such light. This means that the lamp unit will give the impression of darkness, even when sunlight falls onto the lamp unit. When the light source 7–9 is ignited, the layer is irradiated with ultraviolet light 12, which causes the layer to fluoresce. When the layer fluoresces, it transmits light 13 of a visible wavelength, this light therewith being transmitted through the sheet 6. Thus, when the light source is ignited the lamp unit radiates light of high intensity.

As mentioned in the aforegoing, this embodiment affords particular advantage when used in signs of the kind in which the information provided thereon is to be made totally or partially visible during certain time periods, and to remain invisible during the intermediate time periods.

In accordance with one preferred embodiment of the invention the aforementioned substance comprises one or more pigments, each of which transmits a colour in the visible light spectrum when made fluorescent. Such paints or pigments can be applied so that an image or text produced in one or more colours is made visible when irradiated with the aid of the light source. Thus, a road sign or some other sign, symbols etc., can be painted on the rear side 10 of the sheet. In those cases where the sheet 6 is impermeable to ultraviolet light, such a sign will give a dark or black impression which is amplified when the applied paint is transparent or dark when irradiated with visible light. When, on the other hand, the light source 7–9 is ignited, the image and/or the text are highly emphasized and amplified.

Figure 2:
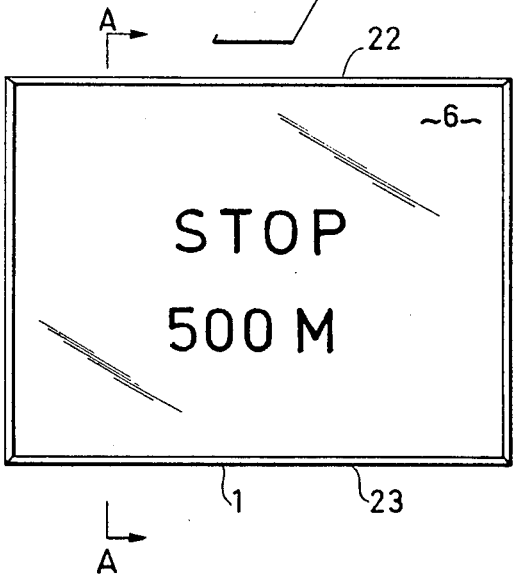
FIG. 2 is a front view of a lamp unit according to the invention.

This is illustrated in FIGS. 2 with the text "STOP 500M", which is painted on the rear side 10 of the sheet 6 and which thus only appears when the light source is ignited.

Figure 3:
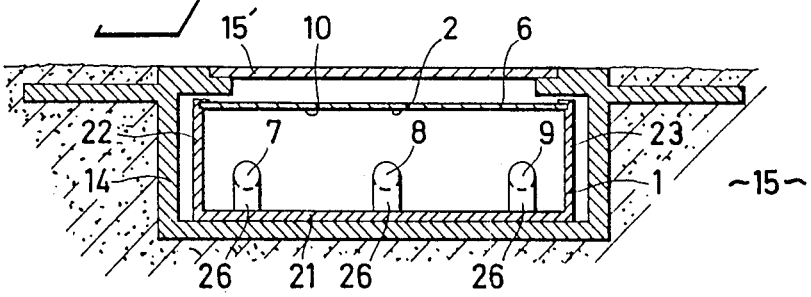
FIG. 3 is a schematic sectional view of an arrangement incorporating a lamp unit according to the invention.

FIG. 3 illustrates by way of example a field of use in which a lamp unit 1 is installed in a sunken structure 14 located in the ground 15. Such sunken structures may be used, for example, as positional marking devices on airfields, or as a storage station for transport containers etc.

In many cases it is desirable to indicate the route to be followed by an aircraft or to illustrate the stop position for a vehicle with the aid of lines placed on the ground or road. The sunken structure 14 is embodied and anchored in the ground. Provided in the upper surface of the sunken structure 14 is a transparent cover plate 15 made, for example, of hardened glass. The lamp unit 1 corresponds to that illustrated in FIG. 1. When daylight enters through the cover 15 and passes through the plate 6, no appreciable fluorescence will result, even though the sheet 6 allows the ultraviolet component of the daylight to pass through. On the other hand, when the light source 7–9 is ignited, the substance layer on the sheet 6 is illuminated and said layer will subsequently radiate light which is transmitted through the cover 15.

Thus, by means of the present invention it is possible to ignite and extinguish outdoor markings and signs, irrespective of whether it is light or dark outdoors.

Figure 4:
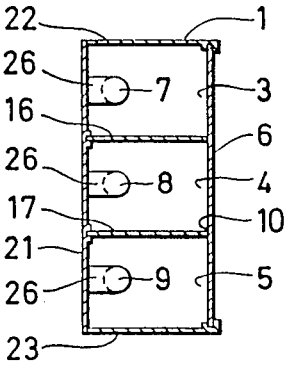
FIG. 4 is a schematic sectional view of a modified embodiment of a lamp unit according to the invention, taken on the line B—B in FIG. 5.
Figure 5:
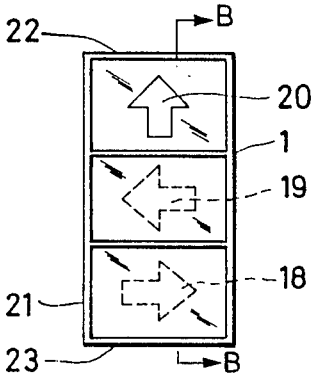
FIG. 5 is a front view of a lamp unit according to FIG. 4.

In accordance with a further preferred embodiment of the invention, exemplified in FIGS. 4 and 5, the lamp unit incorporates a plurality of apertures 3, 4, 5 each of which is covered by a sheet or plate 6.

In this respect, the lamp unit 1 includes screening walls 16, 17 arranged to screen in said body the light emanating from a light source through one or more of the apertures. In the FIG. 4 embodiment, the screening walls 16, 17 are mutually parallel with one another and extend over the width of the lamp unit, such that respective light sources 7, 8, 9 will only illuminate the sheet, or part of the sheet located in the respective apertures 3, 4, 5.

This embodiment is preferably utilized when a sign or the like contains several pieces of information of which only one is to be shown at certain time periods. This is illustrated in FIG. 5 with a direction sign intended, for example, for directing traffic. In this case, an arrow is painted in fluorescent paint on the rear side of the sheet 6 in the location of each of the apertures 3, 4, 5. In the illustrated embodiment it is assumed that the uppermost light source 7 is ignited and the remaining light sources 8, 9 extinguished. The appearance of the non-visible two arrows 18, 19 is illustrated simply in broken lines, while the visible arrow 20 is shown in full lines.

The casing 21–23 of the lamp unit 1 can be made of any suitable material, for example sheet metal. The side walls 22, 23 of the casing suitably incorporate grooves 24, 25 or the like for supporting the sheet or sheets 6. The backpiece 21 of the casing supports attachments 26, 27 for securing the light sources 7, 8, 9, which in the illustrated embodiment have the form of so-called UV-tubes. As will be understood, there may be used either one or more UV-tubes, depending on the effect desired and on the size of the lamp unit.

It will also be understood that the present invention can be applied in all relevant circumstances, and consequently the afore-described fields of application shall be seen merely as arbitrarily selected examples of the extremely large number of fields in which the invention can be conceivably used.

It will also be understood that the structural design of the lamp unit can be modified in a variety of ways obvious to those skilled in this art.

Thus, the invention is not restricted to the aforedescribed and illustrated embodiments and modifications can be made within the scope of the following claims.

I claim:

1. A lamp unit comprising a box-like body which is provided with at least one aperture covered with at least one sheet of material transparent to visible light, and which houses a light source, where the side (10) of said sheet (6) facing inwardly of the body (1) is at least partially covered with a layer of a substance which fluoresces when irradiated with ultraviolet light and where said light source (7,8,9) is arranged to transmit ultraviolet light characterized in that said at least one sheet (6) is made of a material transparent to visible light but impermeable to ultraviolet radiation, in that the substance comprises at least one paint which fluoresces when irradiated with ultraviolet light, thereby giving a visible light but which paint is transparent or dark when irradiated by visible light, and in that an image is applied to said sheet (6) by said paint which fluoresces in a visible colored light, whereby the image only is visible to an observer when the light source radiates ultraviolet light.

2. A lamp unit according to claim 1, characterized in that the light source (7, 8, 9) is arranged to transmit a high proportion of ultraviolet light in the wavelength band of 360–370 nanometers.

3. A lamp unit according to claim 1, characterized in that said sheet (6) provided with a uniform layer of one and the same substance which fluoresces when irradiated with ultraviolet light.

4. A lamp unit according to claim 1, characterized in that the lamp unit incorporates a plurality of apertures (3, 4, 5) covered with a sheet (6) and includes a plurality of light sources (7, 8, 9); and in that screening walls (16, 17) are arranged in said body (1) so as to screen the light from a light source from one or more of said apertures.

5. A lamp unit according to claim 1, wherein said image is in the form of text applied to said sheet.

* * * * *

UNITED STATES PATENT AND TRADEMARK OFFICE

CERTIFICATE OF CORRECTION

PATENT NO. : 4,744,012

DATED : May 10, 1988

INVENTOR(S) : LARS ANDERS BERGKVIST

It is certified that error appears in the above-identified patent and that said Letters Patent is hereby corrected as shown below:

IN THE CLAIMS:

Claim 3, line 2 (Column 4, line 66) after "sheet(6)" insert --is--.

Signed and Sealed this

Eighteenth Day of October, 1988

*Attest:*

DONALD J. QUIGG

*Attesting Officer*

*Commissioner of Patents and Trademarks*